US006467250B2

(12) United States Patent
Kempf

(10) Patent No.: US 6,467,250 B2
(45) Date of Patent: Oct. 22, 2002

(54) METHOD FOR THE MANUFACTURE OF ELASTIC TWISTED YARNS

(75) Inventor: Gerhard Kempf, Frasnacht (CH)

(73) Assignee: Hamel AG, Arbon (CH)

( * ) Notice: Subject to any disclaimer, the term of this patent is extended or adjusted under 35 U.S.C. 154(b) by 0 days.

(21) Appl. No.: 09/836,990

(22) Filed: Apr. 18, 2001

(65) Prior Publication Data

US 2001/0032449 A1 Oct. 25, 2001

(30) Foreign Application Priority Data

Apr. 20, 2000 (DE) ..... 100 19 555

(51) Int. Cl.[7] ..... D02G 3/32
(52) U.S. Cl. ..... 57/12; 57/18
(58) Field of Search ..... 57/1 R, 3, 6, 12, 57/18, 19, 210, 225, 310

(56) References Cited

U.S. PATENT DOCUMENTS 3,257,793 A * 6/1966 Abbott ..... 57/12
4,525,992 A * 7/1985 Payen ..... 57/18
5,154,044 A * 10/1992 Payen ..... 57/58.32

FOREIGN PATENT DOCUMENTS

| | | |
|---|---|---|
| DE | 1173 367 | 5/1958 |
| DE | 1104 653 | 4/1961 |
| EP | 0078 753 | 5/1983 |
| EP | 0157710 A1 * | 10/1985 |

* cited by examiner

*Primary Examiner*—Danny Worrell
*Assistant Examiner*—Shaun R Hurley
(74) *Attorney, Agent, or Firm*—Flynn, Thiel, Boutell & Tanis, P.C.

(57) ABSTRACT

A method for the manufacture of an elastic twisted yarn has at least one outer yarn wound or twisted around an expanded, elastic core yarn. In a first process step the outer yarn is wound around the core yarn with a winding speed providing less than the nominal twist of the finished twisted yarn. The thus formed intermediate yarn is wound up and then twisted in the same direction of rotation in a second process step. In the first process step the outer yarn is wound with the help of a double-pot spindle at a winding rate providing a twist of above 50% of the nominal twist without forming a balloon around the core yarn, and the second process step is carried out on a double-twist spindle.

13 Claims, No Drawings

METHOD FOR THE MANUFACTURE OF ELASTIC TWISTED YARNS

FIELD OF THE INVENTION

The invention relates to a method for the manufacture of an elastic twisted yarn whereby at least one outer yarn is wound or twisted around an expanded, elastic core yarn, and in a first process step the outer yarn is wound or twisted around the core yarn at a winding speed providing less than the nominal twist of the finished twisted yarn. The thus formed in-between yarn is wound up and the in-between yarn is twisted in a second process step in the same direction of rotation in order to obtain the desired nominal twist for the finished twisted yarn.

BACKGROUND OF THE INVENTION

DE 1 173 367 describes a method for the manufacture of yarns in which in a first method step the individual threads are doubled or folded, and are pretwisted with a small twist of up to 3% of the nominal twist. In this manner pretwisted threads are subsequently subjected in a second method step to a further twisting on a bell spindle, whereby the nominal twist is achieved. The first method step is preferably carried out on a ring doubling frame, whereas the high twist in the second method step can, for example, be carried out on a double-twist frame.

It is disadvantageous in this method that the spindle speed is limited to approximately 40 m/s by the rotor speed of the ring spinning frame being used since, as is known, a blocking or rather seizing between the ring and rotor occurs at higher rotor speeds. Higher spindle speeds are thus not possible with the described method.

In addition, conventional twisting machines are known which are also sold under the name Uptwister. Such a twisting machine is, for example, described in the EP 0 078 753 A2. Higher speeds can here basically indeed be achieved due to the missing ring. However, the unwinding speed is limited also in these classic twisting machines, namely because at high spindle speeds the small mass (weight of yarn per meter) of the fine yarns is not sufficient in order to overcome the co-rotating air-limit layer on the surface of the spool. The yarn does not come loose from the spool and a thread balloon is also not formed. This, however, is necessary for an Uptwister process. The centrifugal force of the yarn could indeed be increased with a further increase of the spindle speed, however, as soon as the yarn breaks through the co-rotating air-limit layer and then hits with a high peripheral speed the stationary surrounding air, it is destroyed or at least damaged to the degree that it no longer meets the requirements in the finished product.

Furthermore an extremely high spindle speed on Uptwister twisting machines is not economical because of the high energy consumption.

Furthermore it has in practice been proven to be disadvantageous in the described methods that this behavior also occurs at very low spindle speeds. The air-limit layer does lose its effect, however, the centrifugal force is reduced significantly because of the low speed and the yarn comes no longer loose from the spool. Therefore, when determining the optimum production speed in an Uptwister with a free thread balloon, one has only a very limited margin.

However, an increase of the speed could not be considered since, on the one hand, the energy consumption of a yarn twisting spindle increases significantly with an increasing speed and quickly reaches a range which is no longer economical and, on the other hand, because of the above-disclosed reasons, the thread balloon is incorrectly constructed due to turbulence. As is described in the DE 1 104 653, the energy consumption during twisting depends essentially on the size of the yarn pot and from its speed. The drive power increases approximately with the third power of the speed, with the fourth power of the pot diameter, whereas only approximately with the first power of the pot height. Almost the entire drive power is hereby converted into kinetic energy of the air surrounding the pot, which air at the high speeds of the spinning top of approximately 10,000 rotations/min. and more has a turbulent movement, and therefore creates a high friction. The mentioned reference suggests therefore to provide for the purpose of lowering the energy consumption between the rotating twist chamber and the yarn pot a not driven intermediate housing, which completely or partially surrounds the pot, and which is supported in the spinning chamber or on the drive motor of the pot and is spaced from the wall of the spinning chamber and also from the spinning pot at a distance which is small in relationship to the diameter.

SUMMARY OF THE INVENTION

Therefore, the basic purpose exists to provide a two-step method for the manufacture of an elastic twisted yarn so that it is suited also for very fine yarns but can still be driven very economically.

The invention relates to a method for the manufacture of an elastic twisted yarn, whereby at least one outer yarn is wound or twisted around an expanded, elastic core yarn and in a first process step the outer yarn is wound around the core yarn at a winding speed providing less than the nominal or finished twist of the finished twisted yarn, the thus formed intermediate yarn is wound up, and the in-between yarn is twisted in the same direction of rotation in a second process step. In the first process step the outer yarn is twisted with the help of a double-pot spindle and at a winding rate of above 50% of the nominal twist without a balloon forming around the core yarn, and the second process step is carried out on a double-twist spindle.

DETAILED DESCRIPTION

According to the invention, a so-called double-pot spindle is used in the first process step of the two-step twisting method, which spindle is also known as an energy spindle and the principle design of which is disclosed in the above-mentioned DE 1 104 653. By using such a double-pot spindle in the first process step, significantly higher speeds of far above 10,000 rotations/min. can be achieved; speeds of above 18,000 rotations/min. have already been achieved. With these high speeds it is also assured that very fine yarns can come loose from the edge of the feed spool or bobbin and can thus be processed. At the same time relatively little energy is used in spite of the high speed. Moreover, by using the double-pot spindle in the first process step it is assured that no or only very low turbulences occur during rotation of the thread which keeps the thread tension essentially constant and thread breakages are reliably avoided.

The disadvantages of the open system, which disadvantages are known from the first process step, no longer occur since the rotating inner pot is closed off against the outside air. The inner pot carries the yarn bobbin and thus no air-limit layer is formed on the yarn bobbin and the yarn can come loose unhindered from the bobbin and can be stored on the inner surface of the inner pot prior to being upwardly pulled off. An environment is created for the yarn inside of the inner pot, which environment comes very close to a vacuum. The release of the yarn from the bobbin therefore also does not depend on the spindle speed because the yarn must not overcome any air resistance. The yarn does not come into contact with the stationary outside air even during the twisting operation and can neither be damaged nor destroyed.

In contrast to an open spindle, the air-limit layer is not created on the spindle but on the outer surface of the inner pot. Between the air-limit layer and the stationary surrounding air, friction is created by the turbulent air flow. This friction determines the energy consumption of a pot spindle. The second pot is driven by the air-limit layer of the inner pot and reaches approximately half the speed of the driven inner pot, which causes the relative speed to be divided with respect to the stationary outside air. The drive power of a pot spindle increases with the third power of the speed, namely the sum of $2\times9{,}000\ \text{min}^{-1}$. results compared with $1\times18{,}000\ \text{min.}^{-1}$ with the same production performance with an energy consumption which is approximately 40% less.

By using an energy-saving double-pot spindle without a balloon in the first process step, limitations regarding speed, yarn rotations and material fineness no longer exist. The optimum number of false twists can be freely chosen in the first process step and they are preferably to exceed 50% of the entire rotations in order to obtain optimum conditions in the second process step.

Because of the high speed of the double-pot spindle, a winding or twisting rate is achieved in the first process step, which rate lies far above the known winding rate of 3%, namely more than 50%. Due to this high winding rate, problems also no longer result during the subsequent final twisting on a double-twist frame. These problems were in the known methods that at low winding rates in the first process step (approximately 3%) yarn errors were created in the second process step (double twist), which yarn errors were caused by the cover shifting relative to the core through reciprocal action with the thread brake of the double-twist frame and thus causing local thickenings and thinnings of the yarn. These thickenings and thinnings then occurred as weaving errors in the following fabric. Due to the high winding rate in the first process step such a shifting triggered by the thread brake of the double-twist frame occurs no longer.

What is claimed is:

1. A method for the manufacture of an elastic twisted yarn, whereby at least one outer yarn is wound around an expanded, elastic core yarn, and in a first process step the outer yarn is twisted around the core yarn to form an in-between yarn with a twist which is less than a nominal twist of a finished twisted yarn, the thus formed in-between yarn is wound up and twisted in a second process step in a same direction of rotation as in the first process step in order to obtain the nominal twist of the finished twisted yarn, wherein in the first process step the outer yarn is twisted with the help of a double-pot spindle to above 50% of the nominal twist without forming a balloon around the core yarn, and the second process step is carried out on a double-twist spindle.

2. The method according to claim 1, wherein the twist in he first process step lies between 55 and 70% of the nominal twist.

3. The method according to claim 1, wherein the double-pot spindle is closed off airtight against stationary outside air.

4. A method for manufacturing an elastic twisted yarn having a finished twist comprising:

stretching and advancing an elastic core yarn;

unwinding an outer yarn and twisting the outer yarn around the stretched core yarn in a first direction of rotation at a speed sufficient to form an intermediate yarn having a twist that is greater than 50% of the finished twist of the elastic twisted yarn;

winding the intermediate yarn on a bobbin; and unwinding the intermediate yarn from the bobbin and twisting the intermediate yarn in the first direction of rotation at a winding speed to form the elastic twisted yarn having the finished twist.

5. The method of claim 4, wherein the step of twisting the outer yarn around the core yarn to form the intermediate yarn utilizes a double-pot spindle to prevent a balloon from forming around the core yarn.

6. The method of claim 5, wherein the step of twisting the outer yarn around the core yarn includes driving the double-pot spindle at a speed greater than 10,000 rotations/minute.

7. The method of claim 6, wherein the step of twisting the outer yarn around the stretched core yarn forms the intermediate yarn with a twist greater than 55% and less than 70% of the finished twist of the elastic twisted yarn.

8. The method of claim 5, wherein the step of twisting the outer yarn around the core yarn includes driving the double-pot spindle at a speed greater than 18,000 rotations/minute.

9. The method of claim 5, wherein the step of twisting the intermediate yarn to form the elastic twisted yarn having the finished twist utilizes a double-twist spindle.

10. The method of claim 5, wherein the step of twisting the outer yarn around the stretched core yarn forms the intermediate yarn with a twist greater than 55% and less than 70% of the finished twist of the elastic twisted yarn.

11. The method of claim 4, wherein the step of twisting the intermediate yarn to form the elastic twisted yarn having the finished twist utilizes a double-twist spindle.

12. The method of claim 11, wherein the step of twisting the outer yarn around the stretched core yarn forms the intermediate yarn with a twist greater than 55% and less than 70% of the finished twist of the elastic twisted yarn.

13. The method of claim 4, wherein the step of twisting the outer yarn around the stretched core yarn forms the intermediate yarn with a twist greater than 55% and less than 70% of the finished twist of the elastic twisted yarn.

* * * * *